US006243408B1

(12) United States Patent
Knudsen et al.

(10) Patent No.: US 6,243,408 B1
(45) Date of Patent: Jun. 5, 2001

(54) ELECTRODE WEIGHING STUB

(75) Inventors: Bruce Alan Knudsen, Amsterdam; Russell Scott Miller, Ballston Spa; William Thomas Carter, Jr., Galway; Mark Gilbert Benz, Burnt Hills; Robert John Zabala, Schenectady, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/184,688

(22) Filed: Oct. 2, 1998

(51) Int. Cl.[7] ..... H05B 7/102

(52) U.S. Cl. ..... 373/69; 373/70; 373/52; 373/94

(58) Field of Search ..... 373/51, 52, 69–70, 373/94, 98–101; 75/10.24

(56) References Cited

U.S. PATENT DOCUMENTS 3,272,905 9/1966 Wooding .
4,091,229 * 5/1978 Wooding et al. ..... 373/69
4,131,754 * 12/1978 Roberts ..... 373/70
4,303,797 * 12/1981 Roberts ..... 373/70
4,569,056 * 2/1986 Veil, Jr. ..... 373/70
5,160,532 11/1992 Benz et al. ..... 75/10.24

FOREIGN PATENT DOCUMENTS 1157739 11/1963 (DE) .

OTHER PUBLICATIONS

Leybold, "Vacuum Metallurgy Process and Systems", Leybold Durferrit Gmbh, predates 1997, pp: Cover, 22–27.
European Search Report, EP 99308218, Mar. 2000.

* cited by examiner

*Primary Examiner*—Tu Ba Hoang
(74) *Attorney, Agent, or Firm*—Noreen C. Johnson; Douglas E. Stoner

(57) ABSTRACT

A consumable electrode is suspended by a stub. The stub includes upper and lower hangers between which is vertically mounted a loadcell for weighing the electrode attached to the lower hanger. An electrical conductor is joined between the upper and lower hangers for carrying electrical current therebetween to power the electrode without damaging the loadcell.

14 Claims, 4 Drawing Sheets

32
(−)
52
40
48
58
45
Weigh
44
80
82
60
46
72
70
12
68
78
58
50
62
46
66
46
42
54
56
14

ELECTRODE WEIGHING STUB

BACKGROUND OF THE INVENTION

The present invention relates generally to metal refining, and more specifically, to consumable ingot electrodes therein.

Consumable ingot electrodes are used in various metallurgical processes for controlling metallurgical properties. For example, in vacuum arc remelting (VAR), a consumable electrode is lowered into a crucible maintained under vacuum for controlling the melting thereof. In electroslag remelting or refining (ESR), a consumable electrode is lowered into a crucible, which may have a gas environment, for electrical resistance heating and melting in a corresponding slag for refining the electrode material.

In both embodiments, it is desirable to measure the changing weight of the electrode as it is consumed for in turn controlling corresponding process parameters. This is typically accomplished by using a loadcell system which supports not only the electrode itself, but also the lowering mechanism attached thereto. Accordingly, the weight of the electrode itself is determined after subtracting extraneous loads measured by the loadcell corresponding with the various equipment attached to the electrode.

For example, portions of the lowering equipment are necessarily attached to the electrode and move therewith. This may include a hydraulic ram, or ball screw, or both. Various hoses may be also attached to the lowering mechanism for providing cooling water or inert gas. And, since the crucible typically defines a pressure vessel maintained under vacuum or under gas pressure, suitable seals must be provided between the lowering mechanism and the access port at the top of the crucible over which a substantial pressure difference is maintained. This pressure drop is variable during operation and introduces a variable additional force measured by the loadcell which must be removed in determining the actual weight of the electrode itself.

An improved form of electroslag refining is disclosed in U.S. Pat. No. 5,160,532-Benz et al in which a circumferentially segmented, cold induction guide (CIG) is disposed at the bottom of the electroslag crucible, and includes a drain orifice through which the refined melt may be drained for further use. For example, the melt may be discharged through a gas atomizer for spray forming the melt atop a suitable preform.

It is desirable to accurately control both the drain rate from the crucible for spray forming the preform, as well as controlling the melt rate of the electrode as it is consumed during the electroslag refining process. However, the typical loadcell weighing systems described above necessarily introduce extraneous measured loads in addition to the weight of the electrode itself which requires various corrections for isolating solely the electrode weight.

Accordingly, it is desired to provide an improved electrode weighing mechanism which reduces or eliminates extraneous loads in weighing the electrode.

BRIEF SUMMARY OF THE INVENTION

A consumable electrode is suspended by a stub. The stub includes upper and lower hangers between which is vertically mounted a loadcell for weighing the electrode attached to the lower hanger. An electrical conductor is joined between the upper and lower hangers for carrying electrical current therebetween to power the electrode without damaging the loadcell.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
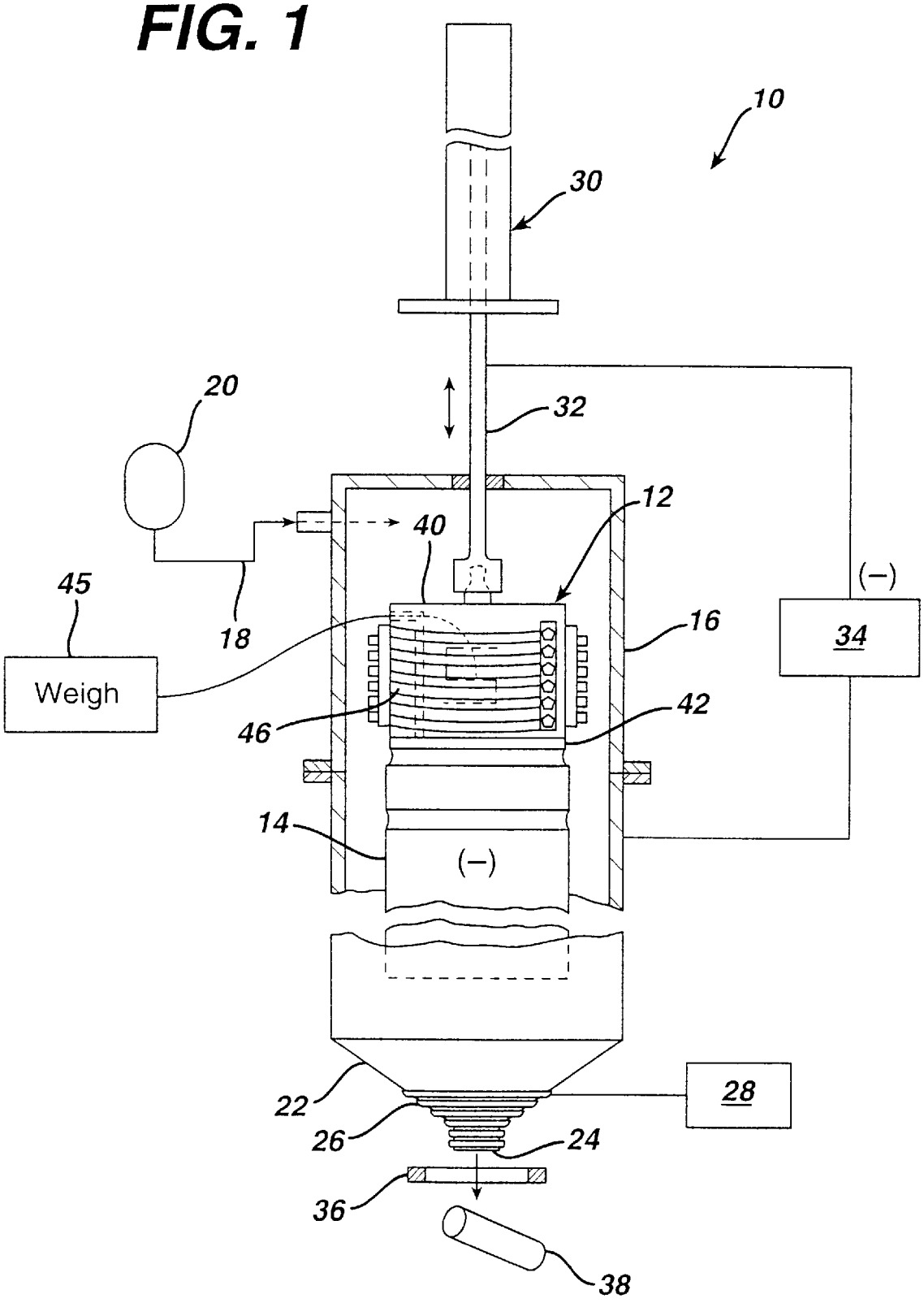
FIG. 1 is a schematic representation of an electroslag refining apparatus including an electrode weighing stub in accordance with an exemplary embodiment of the present invention.

Illustrated schematically in FIG. 1 is an electroslag refining apparatus 10 including an electrode weighing mechanism or stub 12 in accordance with an exemplary embodiment of the present invention. The stub 12 is configured for directly weighing a consumable ingot electrode 14 in situ during the electroslag refining thereof as it is consumed from its lower tip end which decreases its length and weight.

But for the stub 12 itself, the electroslag refining apparatus 10 may have any conventional configuration and operation such as that disclosed in U.S. Pat. No. 5,160,532, incorporated herein by reference. For example, the apparatus 10 includes a water-cooled copper crucible 16 which defines a pressure vessel in which is provided under suitable pressure an inert gas 18 such as argon from a suitable gas supply 20. Disposed at the bottom of crucible 16 is a water-cooled, induction heated, circumferentially segmented, guide 22 having a center drain 24 therein. One or more induction heaters 26 in the form of hollow, water-cooled coils surround the lower end of the guide and the drain and are electrically powered by a power supply 28.

The electrode is attached to the lower end of the stub 12. An elevator 30 has a vertically translatable output rod 32 which extends through a suitable seal in the top of the crucible and is removably fixedly joined to the top of the stub 12 for lowering and raising the electrode 14 as required during the electroslag refining process.

The electrode 14 is joined to a power supply 34 through one or more electrical leads joined to the output rod 32 for carrying electrical current through the stub 12 to the electrode 14. A suitable slag is disposed in the bottom of the crucible and is electrically resistively heated by current flow from the electrode 14 into the crucible 16 which is also joined to the power supply 34 by another electrical lead.

During operation, the slag in the crucible is heated by resistance heating thereof which in turn melts the lower, tip end of the electrode 14, with the melt therefrom being refined by the liquid slag as it drops by gravity to the bottom of the crucible atop the guide 22. The molten slag floats atop the refined ingot melt, and corresponding solidified skulls are formed along the inner surface of the crucible and guide for maintaining the purity of the refined melt during operation. The melt is drained from the orifice 24 by controlling the induction heating thereof by the surrounding induction heater 26, and therefore skull thickness, with the melt being discharged through a gas atomizer 36 which sprays the melt atop a preform 38 for building thereatop successive layers of the refined melt which solidify thereon.

As the electrode 14 is consumed during operation, its weight correspondingly decreases. Accordingly, by weighing the electrode in situ inside the crucible 16 during the electroslag refining process, that weight may be used in precisely controlling the entire refining process, including the discharge flowrate of the melt from the drain 24 in the subsequent spray forming operation.

In accordance with the present invention as initially illustrated in FIG. 1, the stub 12 is an assembly of components sized and configured to fit within the crucible for directly weighing the electrode 14 during operation as it is consumed. The weighing stub 12 also provides an electrical current path to the electrode 14 for the large electrical current flow required for electrical resistance heating of the molten slag for melting the electrode tip.

Figure 2:
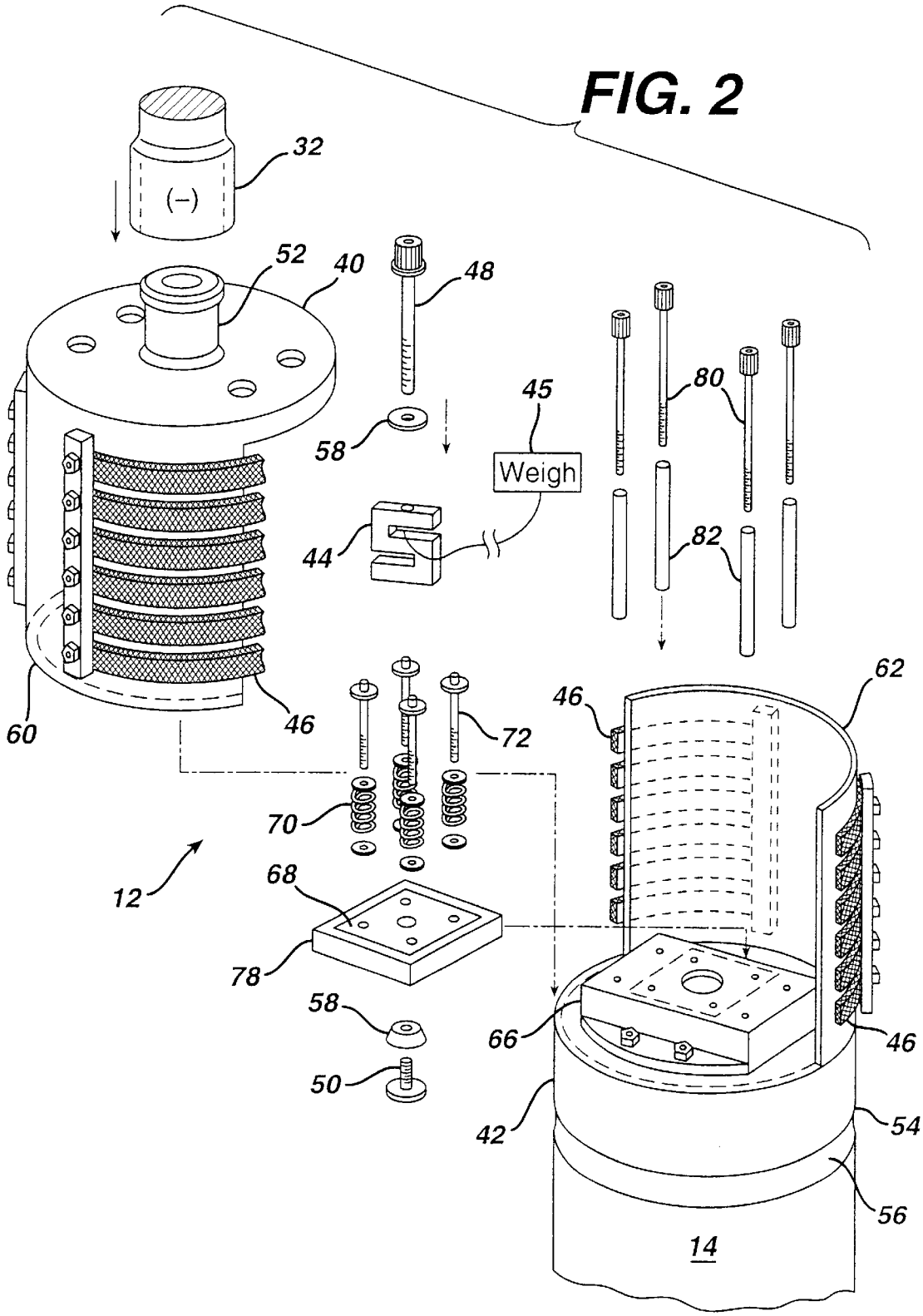
FIG. 2 is an exploded view of the electrode weighing stub illustrated in FIG. 1 in accordance with an exemplary embodiment of the present invention.

The stub 12 is illustrated in more detail in exploded view in FIG. 2. The stub includes an upper head or hanger 40, and lower head or hanger 42 disposed vertically below the upper hanger and configured for fixedly suspending the electrode 14. A loadcell 44 is mounted vertically between the upper and lower hangers for weighing the electrode attached to the lower hanger during operation.

The loadcell 44 may have any conventional form such as the S-configuration illustrated in FIG. 2 for measuring the amount of vertically directed load between its upper and lower legs. The S-configuration provides a middle leg which undergoes bending upon application of vertical tensile loads across the loadcell, with the bending stress being measured by strain gages thereon which are electrically joined to a remote weighing scale 45 in the preferred form of a suitable electrical circuit. An exemplary loadcell is commercially available from Hardy Instruments, of San Diego, Calif. under model No. HI LPT5K.

At least one, and preferably several electrical conductors 46 are fixedly joined between the upper and lower hangers for carrying electrical current therebetween to power the electrode during operation, while bypassing the loadcell 44 for preventing damage thereto.

Figure 3:
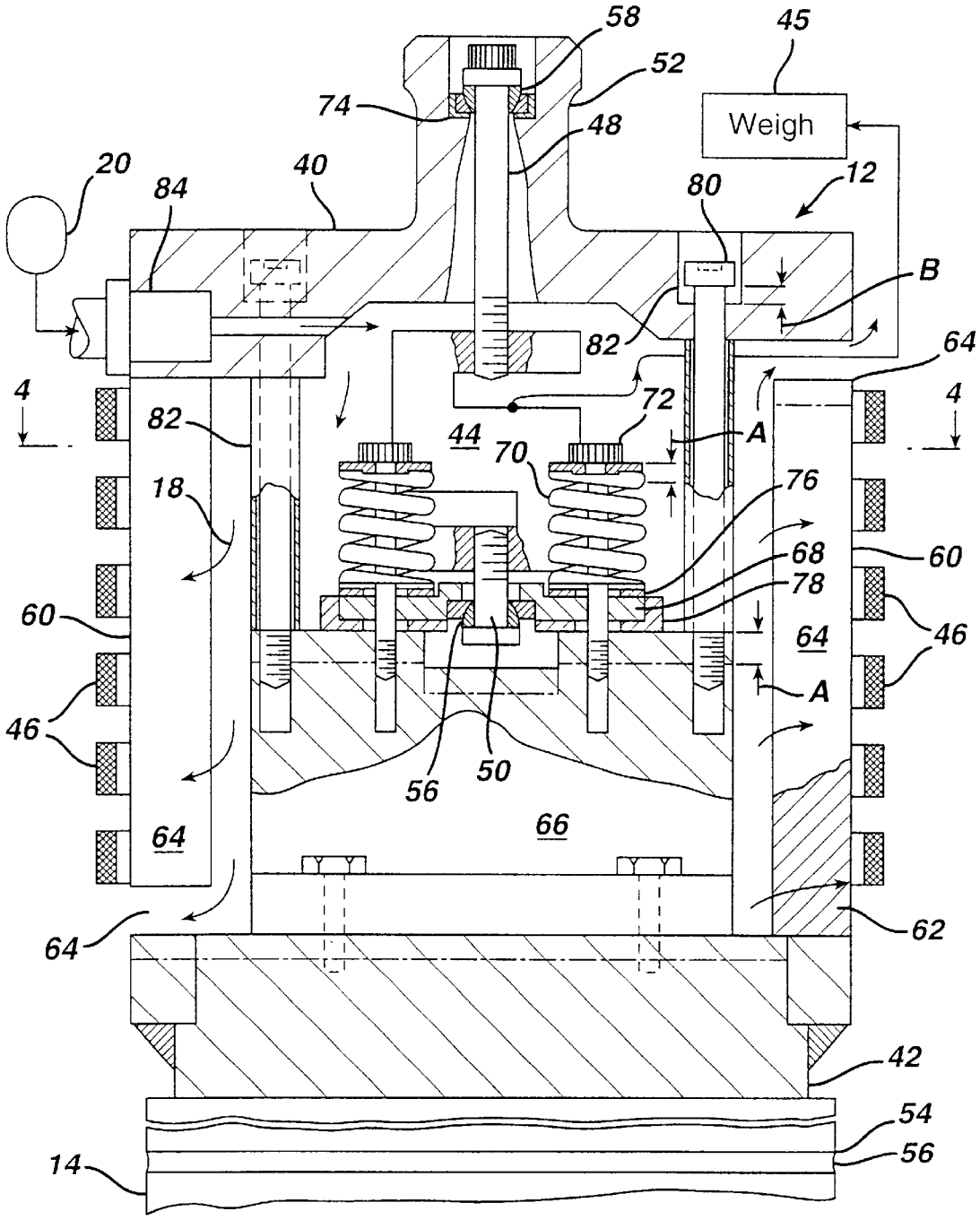
FIG. 3 is a partly sectional, elevational view of the stub illustrated in FIGS. 1 and 2.

In the preferred embodiment illustrated in FIGS. 2 and 3, the loadcell is pivotally joined to both the upper and lower hangers for preventing undesirable bending moments across the loadcell so that it may be disposed primarily under tensile loads between the upper and lower hangers. This is done by using a pair of coaxial upper and lower bolts 48,50 which threadingly engage the corresponding upper and lower legs of the loadcell 44.

In the exemplary embodiment illustrated in FIG. 3, the upper hanger 40 is in the form of an annular copper plate or disk and includes a vertical center trunnion 52 extending integrally upwardly therefrom for lifting the stub and attached electrode. The outer configuration of the trunnion 52 may have any conventional form for engaging a complementary socket in the lower end of the elevator rod 32 illustrated in FIG. 2 for providing a removable connection thereat. With the trunnion engaging the elevator rod 32, the entire stub and electrode may be lowered or lifted as desired by the elevator.

As shown in FIGS. 2 and 3, the lower hanger 42 is preferably a solid rod having a lower end defining a weld prep 54 configured for welding the electrode 14 thereto at a suitable weld bead 56. The lower hanger 42 is preferably formed of stainless steel for both its electrical conductivity and its ability to be repeatedly welded in turn to a series of electrodes 14 as they are consumed and then removed from the lower hanger 42 by grinding away the previous weld bead 56.

As shown in FIG. 3, the upper bolt 48 extends downwardly through the trunnion 52 and is pivotally joined or seated therein in a spherical bearing 58 mounted in a corresponding spherical seat. The head of the upper bolt 48 is preferably recessed in a counterbore in the top of the trunnion 52, and the lower, distal end of the upper bolt threadingly engages the upper leg of the loadcell 44 to fixedly join the loadcell to the upper hanger 40 with pivotal capability.

Correspondingly, the lower bolt 50 extends upwardly from the lower hanger 42 and is pivotally joined or seated therein in an identical spherical bearing 58. The head of the lower bolt 50 is therefore fixedly joined to the lower hanger with pivotal capability, and the upper, distal end of the lower bolt threadingly engages the lower leg of the loadcell 44 coaxially with the upper bolt. In this way, the loadcell 44 is pivotally joined at its opposite upper and lower legs to the corresponding upper and lower hangers.

The weight of the electrode 14 is directly carried by the lower hanger 42 and in turn through the single lower bolt 50 into the loadcell 44, which in turn is suspended to the upper hanger 40 by the single upper bolt 48. In this way, the loadcell 44 is directly mounted to the electrode through the lower hanger 42 and directly measures the weight of the electrode 14, except for the intervening components supported by the lower bolt 50 whose weight is a constant which may be suitably removed from the total weight detected by the loadcell.

As initially shown in FIG. 2, the weighing stub 12 preferably also includes an upper shield or case 60 fixedly joined to and extending below the upper hanger 40. The upper case is preferably arcuate or semi-tubular, and formed of copper for providing a low resistance electrical conducting path from the copper upper hanger and trunnion.

Correspondingly, a lower case 62 is fixedly joined to the lower hanger 42 and extends upwardly therefrom and adjacent to the upper case 60. The lower case 62 is also preferably arcuate or semitubular and is complementary with the upper case 60 for collectively surrounding the loadcell 44. The lower case 62 adjoins the upper case 60 coaxially therewith and is separated therefrom by a gap 64 extending vertically and horizontally therebetween in opposite pairs to collectively define a segmented tubular enclosure around the loadcell.

The tubular or cylindrical cases 60,62 not only surround the loadcell 44 for protection thereof, but also define integral extensions of the upper and lower hangers, respectively for carrying the high electrical current required for powering the electrode 14. Like the upper case 60, the lower case 62 is also preferably copper having low electrical resistance, and both provide relatively large cross sectional areas for carrying current with the respective hangers.

Figure 4:
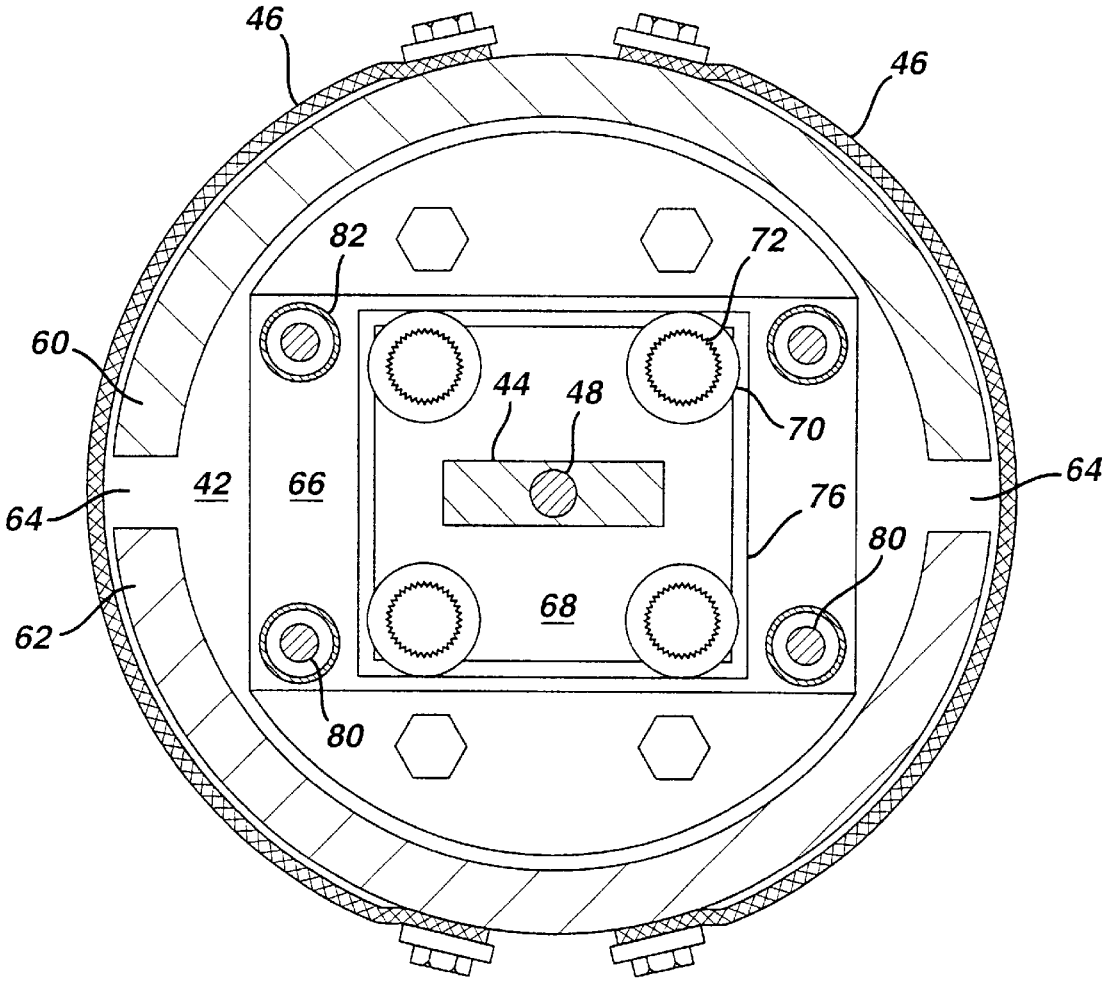
FIG. 4 is a horizontal sectional view through the weighing stub illustrated in FIG. 3 and taken along line 4—4.

As shown in FIGS. 3 and 4, a plurality of the electrical conductors 46 are preferably fixedly joined at opposite ends thereof to the respective upper and lower cases 60,62 for carrying the electrical current therebetween. Each conductor 46 is preferably flexible in its lateral direction by being formed of a plurality of thin gauge copper wires braided together. The opposite ends of the conductors 46 may be suitably clamped to the corresponding casings using a bus bar and several mounting bolts as desired.

The several conductors 46 are preferably disposed circumferentially between the upper and lower cases across the two vertical portions of the gap 64 to carry the substantial electrical current from the upper hanger 40 to the lower hanger 42 and in turn to the electrode 14 welded to the lower hanger. The electrical current is supplied to the stub 12 through the elevator rod 32 and its connection to the trunnion 52 in a continuous and relatively large cross sectional area current path.

The lateral flexibility of the conductors 46 allows relatively free vertical movement between the upper and lower hangers for reducing or eliminating weighing errors during operation. This may be simply effected by calibrating the loadcell 44 after complete assembly of the stub 12 to a zero initial weight without the attached electrode 14, or to the actual weight of the electrode 14 when attached.

The bifurcated construction of the upper and lower hangers 40,42 and their attached cases 60,62 allows the direct mounting of the loadcell 44 vertically therebetween for more accurately weighing the electrode 14 as it is consumed during operation. The pivoted upper and lower bolts further protect the loadcell from undesirable bending moments which may occur upon lateral movement of the electrode 14 as it is transported and moved during operation.

It is also desirable to further protect the loadcell 44 against excess tension loads therein which might occur, for example, in the event the electrode 14 sticks during operation as the elevator attempts to raise the electrode. Accordingly, the loadcell 44 illustrated in FIG. 3 forms part of a primary loadpath between the upper and lower hangers, and a secondary loadpath is provided in parallel with the primary loadpath with a predetermined amount of backlash sized to supplant the primary loadpath upon excess load on the lower hanger.

More specifically, the primary loadpath preferably also includes a steel mounting block 66 fixedly joined atop the lower hanger 42 as illustrated in FIG. 3, such as being bolted thereto. A cooperating steel mounting plate 68 is disposed in abutment atop the mounting block 66. The mounting plate 68 includes a central aperture in which the lower bearing 58 is mounted on the under surface thereof, with the head of the lower bolt 50 being disposed in a corresponding recess in the upper surface of the mounting block 66.

A plurality of compression springs 70, such as the four illustrated in FIGS. 2–4, are disposed atop the four corners of the mounting plate symmetrically about the lower bolt 50 disposed therebetween. A plurality of primary mounting bolts 72 extend through respective ones of the springs 70, and extend freely through corresponding apertures in the mounting plate 68. The heads of the bolts sit atop washers on the respective springs, with their lower distal ends being threadingly engaged in the mounting block 66 for clamping the mounting plate in abutment atop the mounting block 66 which extends upwardly from the lower hanger 42.

In order to protect the loadcell 44 from the high electrical current carried through the upper and lower hangers, the upper and lower bolts 48,50 as illustrated in FIG. 3 are preferably electrically insulated from the corresponding upper and lower hangers 40,42. In one embodiment, an electrically insulating washer 74 is disposed in the counterbore at the top of the trunnion 52 for supporting the seat of the spherical bearing 58. In this way, the electrical path from the trunnion 52 to the upper bolt 48 is interrupted.

Correspondingly, additionally electrically insulating washers 76 are disposed between the bottom of the springs 70 and the top of the mounting plate 68 as illustrated in FIG. 3, with an electrically insulating pad 78 being disposed between the mounting plate 68 and the mounting block 66 to interrupt the electrical path therebetween.

In this way, the primary loadpath between the upper and lower hangers includes in sequence the upper bolt 48, the loadcell 44, the lower bolt 50, the mounting plate 68, the coil springs 70, the primary bolts 72, and the mounting block 66. The coil springs 70 are preferably sized for collectively carrying the intended weight of the electrode 14 with little if any additional compression thereof.

In the event the electrode 14 sticks to the crucible during operation and the elevator attempts to raise the stub 12, the four springs will experience a load increase and further compression that will unseat the bottom of the pad 78 from the top of the mounting block 66 as represented by a vertical relief gap A therebetween shown in phantom in FIG. 3. As the springs 70 compress in response to a vertical load exceeding the weight of the electrode 14 itself, that load is nevertheless still carried by the loadcell 44 and opens the relief gap A.

Since the loadcell 44 has a predetermined load limit, it is undesirable to exceed that limit. Accordingly, the secondary loadpath is configured to bypass the primary loadpath upon excess vertical load through the springs and loadcell, and includes a plurality of secondary mounting bolts 80 shown in FIGS. 2–4. The secondary bolts are arranged in a symmetrical group of four corresponding to the four primary bolts 72. They extend downwardly through corresponding counterbores and apertures in the upper hanger 40, and have lower distal ends threadingly engaging the mounting block 66 to fixedly attach the secondary bolts thereto.

Each of the secondary bolts includes an upper enlarged head spaced vertically atop a corresponding seat in the upper hanger to define a predetermined gap or backlash B. The backlash between the secondary bolts 80 and the upper hanger 40 is selected to allow limited additional compression of the springs 70 as vertical loads through the primary bolts 72 collectively exceed the desired limit for the loadcell 44 and opens the relief gap A.

As the mounting block 66 and pad 78 separate during excess compression of the springs 70, the secondary bolts 80 are correspondingly lowered in the upper hanger until the backlash is depleted and the heads of the secondary bolts contact their respective seats therein. At this point, the excess vertical loads from the mounting block 66 are carried instead through the four secondary bolts 80 directly into the upper hanger 40 bypassing the four primary bolts and the loadcell 44.

The loadcell 44 is therefore mounted between the upper and lower hangers for accurately measuring the weight of the suspended electrode 14, yet vertical loads in excess of the electrode weight may be bypassed through the secondary bolts 80 directly to the upper hanger for preventing excess loads through the loadcell and preventing damage thereto.

The secondary bolts 80 also provide a convenient manner for locking together the upper and lower hangers when desired during assembly of the electrode thereto and prior to insertion of the electrode into the crucible. This may be effected by providing a corresponding plurality of locking tubes or sleeves 82 around each of the respective secondary bolts 80 and sized in length to match the available height between the bottom of the upper hanger and the top of the mounting block when the mounting plate 68 and its underlying pad 78 are seated in abutment against the top of the mounting block.

The secondary bolts 80 may then be screwed down when desired so that the heads thereof engage their seats in the upper hanger to clamp together the upper and lower hangers on the sleeves 82 to bypass the loadcell 44. The locked down secondary bolts 80 prevent relative vertical movement between the upper and lower hangers and thusly lock together the two hangers in a rigid assembly during assembly and transport of the stub and electrode prior to final assembly inside the crucible. The secondary bolts 80 may then be partially unscrewed to the desired backlash clearance B prior to electroslag refining so that the loadcell may then be used for accurately measuring the weight of the electrode 14 as it is consumed.

As shown in FIG. 3, the stub 12 preferably also includes means in the form of a gas inlet 84 disposed in flow communication with the gas supply 20, or other suitable source, for providing a coolant, such as the argon gas, inside the upper and lower cases 60,62 for cooling the loadcell, with the spent gas being discharged through the vertical and horizontal portions of the gap 64.

As indicated above, the loadcell 44 is protected both mechanically and electrically inside the two cases 60,62 and vertically between the two hangers 40,42. The electrical conductors 46 provide a larger-area current path for the high currents required for electroslag refining which bypass the electrically insulated loadcell 44. Since heat is nevertheless a byproduct of the electroslag refining process, the coolant channeled through the stub effectively cools the loadcell for ensuring a useful life thereof while maintaining weighing accuracy during operation.

The primary loadpath through the loadcell, including the spherically mounted bolts 48,50, ensures tensile loading of the loadcell without undesirable bending moments therein. And, the secondary loadpath provided by the bolts 80 protect the loadcell from excessive vertical loads therethrough, as well as provides a failsafe or backup loadpath in the event of separation failure of the loadcell itself.

Since the loadcell 44 is directly mounted between the upper and lower hangers immediately adjacent to the electrode 14, it is effective for providing substantially more accurate weight measurement of the electrode 14 as it is consumed during operation without undesirable additional loads therethrough which would otherwise require compensation.

The weighing stub 12 therefore provides a mechanical connection to the electrode 14 for suspending the electrode from the elevator rod 32, while carrying the substantially high electrical current through the stub to the electrode as required for electroslag refining. In this configuration, the loadcell does not weigh any other component above the stub including any portions of the elevator 30 or its output rod 32. Nor, is the weighing stub 12 subject to measuring errors due to differential pressure between the inside and outside of the crucible 16.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A stub for suspending a consumable electrode inside a crucible comprising:

an upper hanger;

a lower hanger for fixedly suspending said electrode;

a loadcell mounted vertically between said upper and lower hangers for weighing said electrode; and an electrical conductor surrounding said loadcell and joined between said upper and lower hangers for carrying electrical current therebetween to power said electrode.

2. A stub according to claim 1 wherein said loadcell is pivotally joined to both said upper and lower hangers.

3. A stub according to claim 2 further comprising:

an upper case fixedly joined to said upper hanger;

a lower case fixedly joined to said lower hanger adjacent said upper case, and being complementary therewith for collectively surrounding said loadcell; and said conductor is joined at opposite ends thereof to said upper and lower cases for carrying said electrical current therebetween.

4. A stub according to claim 3 further comprising a primary loadpath, including said loadcell, between said upper and lower hangers, and a secondary loadpath therebetween having backlash sized to supplant said primary loadpath upon excess load on said lower hanger.

5. A stub according to claim 4 wherein:

said upper hanger includes a vertical trunnion extending upwardly therefrom for lifting said stub and attached electrode; and said lower hanger includes a weld prep therebelow for welding said electrode thereto.

6. A stub according to claim 5 further comprising:

an upper bolt extending downwardly through said trunnion and pivotally seated therein, and fixedly joined to said loadcell; and a lower bolt extending upwardly from said lower hanger and pivotally seated therein, and fixedly joined to said loadcell coaxially with said upper bolt for pivotally joining said loadcell to both said upper and lower hangers.

7. A stub according to claim 6 wherein said upper bolt is electrically insulated from said upper hanger, and said lower bolt is electrically insulated from said lower hanger.

8. A stub according to claim 4 wherein:

said upper case is arcuate;

said lower case is arcuate and adjoins said upper case at a gap therebetween to collectively define a segmented tubular enclosure around said loadcell; and said conductor is flexible and disposed circumferentially between said upper and lower cases across said gap.

9. A stub according to claim 4 wherein said primary loadpath comprises:

a mounting plate disposed atop said lower hanger, and pivotally joined to said loadcell;

a plurality of springs disposed atop said mounting plate; and a plurality of mounting bolts extending through respective ones of said springs and said mounting plate, and fixedly joined to said lower hanger for clamping said mounting plate in abutment atop said lower hanger.

10. A stub according to claim 9 wherein said secondary loadpath comprises:

a plurality of secondary bolts extending through said upper hanger and fixedly joined to said lower hanger; and each of said secondary bolts includes a head spaced vertically atop a corresponding seat in said upper hanger to define said backlash.

11. A stub according to claim 10 further comprising a sleeve surrounding each of said secondary bolts between said upper and lower hangers.

12. A stub according to claim 10 further comprising a mounting block fixedly joined atop said lower hanger, and said mounting plate is clamped thereatop.

13. A stub according to claim 12 further comprising an electrical insulating pad disposed between said mounting plate and said mounting block.

14. A stub according to claim 10 further comprising means for channeling a coolant inside said upper and lower cases for cooling said loadcell.

* * * * *